US009875639B2

(12) United States Patent
Bone et al.

(10) Patent No.: US 9,875,639 B2
(45) Date of Patent: Jan. 23, 2018

(54) HAND-WASHING COMPLIANCE DEVICE WITH A MOTION-ACTIVATED DISPLAY OF MOTION-CONTROLLED MESSAGES

(71) Applicants: Matthew Bone, Warner Robins, GA (US); Josh Mullis, Kennesaw, GA (US)

(72) Inventors: Matthew Bone, Warner Robins, GA (US); Josh Mullis, Kennesaw, GA (US)

(73) Assignee: Matthew Bone, Warner Robins, GA (US)

( * ) Notice: Subject to any disclaimer, the term of this patent is extended or adjusted under 35 U.S.C. 154(b) by 0 days.

(21) Appl. No.: 14/885,486

(22) Filed: Oct. 16, 2015

(65) Prior Publication Data

US 2016/0133119 A1 May 12, 2016

Related U.S. Application Data

(60) Provisional application No. 62/078,725, filed on Nov. 12, 2014.

(51) Int. Cl.
*G08B 3/00* (2006.01)
*G08B 21/24* (2006.01)

(52) U.S. Cl.
CPC ..... *G08B 21/245* (2013.01)

(58) Field of Classification Search
CPC ..... G08B 21/245
USPC ..... 340/691.6, 815.4, 573.1, 539.11–539.13, 340/539.23
See application file for complete search history.

(56) References Cited

U.S. PATENT DOCUMENTS

| | | | | |
|---|---|---|---|---|
| 5,870,015 | A * | 2/1999 | Hinkel | A47K 13/24 340/573.1 |
| 2009/0091458 | A1* | 4/2009 | Deutsch | G08B 21/245 340/573.1 |
| 2010/0282772 | A1* | 11/2010 | Ionidis | A47K 5/1217 222/1 |
| 2014/0245161 | A1* | 8/2014 | Yuen | G06F 3/011 715/736 |
| 2015/0199883 | A1* | 7/2015 | Hartley | G08B 21/245 340/686.6 |
| 2015/0216369 | A1* | 8/2015 | Hamilton | G08B 21/245 222/1 |

* cited by examiner

*Primary Examiner* — Thomas Mullen

(57) ABSTRACT

Methods, systems and devices are provided for hand-washing compliance device with a motion-activated display of motion-controlled messages. In one embodiment, method for presenting and controlling a message on a motion-activated display is provided.

9 Claims, 11 Drawing Sheets

HAND-WASHING COMPLIANCE DEVICE WITH A MOTION-ACTIVATED DISPLAY OF MOTION-CONTROLLED MESSAGES

BACKGROUND OF THE INVENTION

Hand-washing is globally recognized as the #1 method for disease prevention, yet there are numerous studies showing its misuse. The biggest concerns are not washing your hands long enough, not lathering with soap, or skipping out altogether. Even while organizations such as the CDC actively encourage their hand-washing guidelines, at home and within every industry there are several cases ranging from the common cold to a foodborne illness outbreak that can be prevented by following CDC hand-washing guidelines.

To combat the hand-washing compliance issues in several industries, the method of wearing a device that notifies the user to wash their hands when in proximity of another sensor has become common. However, its main restriction is that it limits the number of users to those who are given access to wear the device—which is commonly withheld for faculty/staff. Furthermore, the device purely serves as a reminder via notifications and does not provide any source of entertainment. Within the home, the technological advances are even fewer beyond the realm of automated soap dispensers and responsible parents lecturing children. Altogether, an encouraging and engaging experience that instills healthy hand-washing habits for both the community and the industry is lacking.

It is in this context that embodiments of the invention arise.

BRIEF SUMMARY OF THE INVENTION

Embodiments described in the present disclosure provide systems, apparatus, computer readable media, and methods for displaying motion-controlled messages on a motion-activated display.

In one embodiment, a method for presenting and controlling a message on a motion-activated display is provided, including: storing a plurality of messages to the hand-washing compliance device's message storage; determining a non-user interactive state of the device; determining a change of the device from the non-user interactive state to a user interactive state related to the user washing their hands; in response to determining the change from the non-user interactive state to the user interactive state, select one or more of the plurality of messages, and display the selected message(s) in accordance with its parameters; wherein at least one of the parameters of at least one of the selected messages is controlled by motion or an absence thereof detected; wherein at least one of the plurality of messages is based on one or more of a length of time of the non-user interactive state, a current time of day, a current location of the device, or an account history associated with the device; wherein the method is executed by at least one processor.

In one embodiment, determining a non-user interactive state includes remaining in a motionless environment for a predefined time period; and wherein determining the change of the device from the non-user interactive state to a user interactive state includes the detection of motion from the non-user interactive state.

In one embodiment, storing a plurality of messages includes identifying the hand-washing compliance device to a server and downloading a plurality of messages from the server, the server being configured to access a user account associated with the device, the plurality of messages being selected by the server based on the user account.

In one embodiment, at least one of the plurality of messages is defined based on one or more of a current date, a location of the device, a current season, or a current weather.

In one embodiment, at least one of the plurality of messages is defined based on an account history associated with the device.

In another embodiment, a method for presenting and controlling a message on a motion-activated display is provided, comprising: storing a plurality of messages to the devicehand-washing compliance device's message storage; determining a motionless environment; detecting motion or an absence thereof to or from the motionless environment related to the user washing his hands; in response to detecting the motion or an absence thereof to or from the motionless environment, select one or more of the plurality of messages, and display the selected message(s) in accordance with its parameters; wherein at least one of the parameters of at least one of the selected messages is controlled by the motion or an absence thereof detected; wherein at least one of the plurality of messages is defined based on one or more of a current date, a location of the device, a current time of day, or an account history associated with the device; wherein the method is executed by at least one processor.

In one embodiment, determining a motionless environment includes detecting an absence of motion within the detection range of the hand-washing compliance device's motion sensor for a predefined time period.

In one embodiment, storing a plurality of messages includes identifying the hand-washing compliance device to a server and downloading a plurality of messages from the server, the server being configured to access a user account associated with the device, the plurality of messages being selected by the server based on the user account.

In one embodiment, at least one of the plurality of messages is defined based on an account history associated with the device.

In another embodiment, a hand-washing compliance device is provided, comprising: a message storage configured to store a plurality of messages; a motion sensor; a display; logic configured to determine, based on output of the motion sensor, a motionless environment and detect motion or an absence thereof to or from the motionless environment related to the user washing his hands, and, in response to detecting the motion or an absence thereof to or from the motionless environment, select one or more of the plurality of messages, and display the selected message(s) in accordance with its parameters; logic configured determine a non-user interactive state of the device and a subsequent change to a user interactive state of the device, and, in response to determining the change to the user interactive state, select one or more of the plurality of messages, and display the selected message(s) in accordance with its' parameters; wherein at least one of the plurality of messages is defined based on an account history associated with the device; wherein the method is executed by at least one processor.

In one embodiment, determining a motionless environment includes detecting an absence of motion within the detection range of the hand-washing compliance device's motion sensor for a predefined time period.

In one embodiment, determining a non-user interactive state includes remaining in a motionless environment for a predefined time period; and wherein determining the change of the device from the non-user interactive state to a user interactive state includes the detection of motion from the non-user interactive state.

In one embodiment, the hand-washing compliance device further comprises: logic configured to download a plurality of messages to the hand-washing compliance device's message storage, wherein the downloading includes identifying the device to a server, the server being configured to access a user account associated with the device, the plurality of messages being selected by the server based on the user account.

Other aspects will become apparent from the following detailed description, taken in conjunction with the accompanying drawings, illustrating by way of example the principles of embodiments described in the present disclosure.

BRIEF DESCRIPTION OF THE DRAWINGS

FIG. 2 illustrates an example of a hand-washing compliance device in communication with a remote device, in accordance with one embodiment of the present invention.

DETAILED DESCRIPTION OF THE INVENTION

Embodiments described in the present disclosure provide systems, apparatus, computer readable media, and methods for displaying motion-controlled messages on a motion-activated display.

It should be noted that there are many inventions described and illustrated herein. The present inventions are neither limited to any single aspect nor embodiment thereof, nor to any combinations and/or permutations of such aspects and/or embodiments. Moreover, each of the aspects of the present inventions, and/or embodiments thereof, may be employed alone or in combination with one or more of the other aspects of the present inventions and/or embodiments thereof. For the sake of brevity, many of those permutations and combinations will not be discussed separately herein.

Further, in the course of describing and illustrating the present inventions, various circuitry, architectures, structures, components, functions and/or elements, as well as combinations and/or permutations thereof, are set forth. It should be understood that circuitry, architectures, structures, components, functions and/or elements other than those specifically described and illustrated, are contemplated and are within the scope of the present inventions, as well as combinations and/or permutations thereof.

Figure 1:
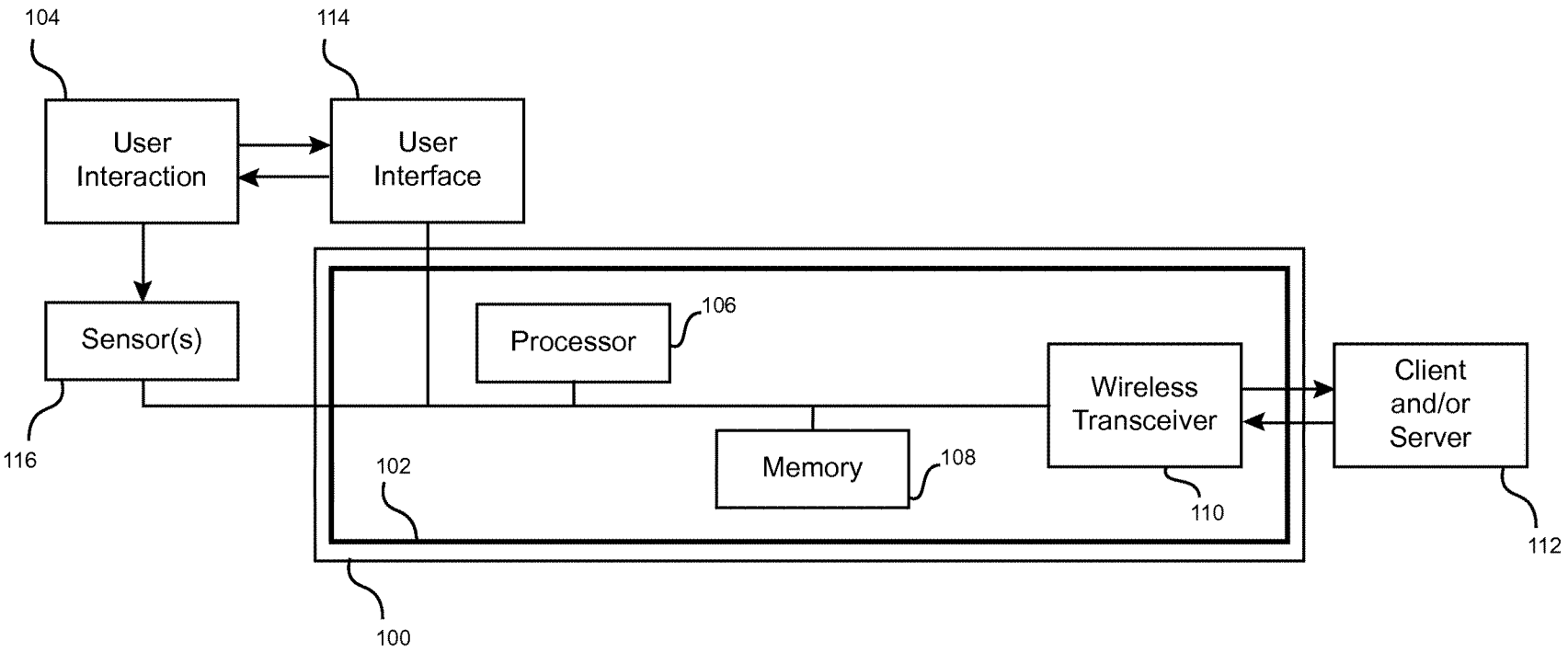
FIG. 1 illustrates a side view of a hand-washing compliance device installed to a hand-washing station, in accordance with an embodiment of the invention.

FIG. 1 shows a block diagram of a hand-washing compliance device 100, in accordance with one embodiment of the present invention. The hand-washing compliance device 100 is contained in a housing, and may be hidden from the user's sight. The hand-washing compliance device 100 includes device components 102, which may be in the form of logic, storage, and glue logic, one or more processors, microelectronics, and interfacing circuitry. In one example, the components 102 will include a processor 106, memory 108, a wireless transceiver 110, a user interface 114, and external sensors 116. In one embodiment, sensors 116 may be internal.

The sensors 116 may be in the form of motion detecting sensors, biometric sensors, or environmental sensors. In some embodiments, a motion sensor can be one or more of an accelerometer, or a gyroscope, or a rotary encoder, or an ultrasonic sensor, or a linear motion sensor, or an angular motion sensor, or a multi-axis motion sensor, or an infrared sensor, or a video motion sensor, a microwave sensor, or a combination thereof. The sensors 116 may be defined to measure physiological characteristics of the user that is using the hand-washing compliance device 100. In some embodiments, a sensor can be used for facial recognition, finger print scanning, etc. The user interface 114 provides a way for communicating with the hand-washing compliance device 100, in response to user interaction 104. In one embodiment, the user interaction 104 can be in the form of non-physical contact (e.g., without limitation, motion detection, voice commands, noise detection, facial recognition, etc.). In other embodiments, the user interaction 104 may also be in the form of physical contact (e.g., without limitation, tapping, sliding, rubbing, multiple taps, gestures, etc.).

In some embodiments, the user interface 114 is configured to receive user interaction 104 by way of motion sensors, proximity sensors, button presses, touch sensitive screen inputs, graphical user interface inputs, voice inputs, sound inputs, etc. The hand-washing compliance device 100 can communicate with a client and/or server 112 using the wireless transceiver 110. The wireless transceiver 110 will allow the hand-washing compliance device 100 to communicate using a wireless connection, which is enabled by wireless communication logic. The wireless communication logic can be in the form of a circuit having radio communication capabilities. The radio communication capabilities can be in the form of a Wi-Fi connection, a Bluetooth connection, a low-energy Bluetooth connection, or any other form of wireless tethering or near field communication. In still other embodiments, the hand-washing compliance device 100 can communicate with other computing devices using a wired connection (not shown). As mentioned, the sensors 116 can detect motion. The motion can be activity of the user, such as walking within proximity, rinsing their hands, acquiring soap, etc.

Figure 2:
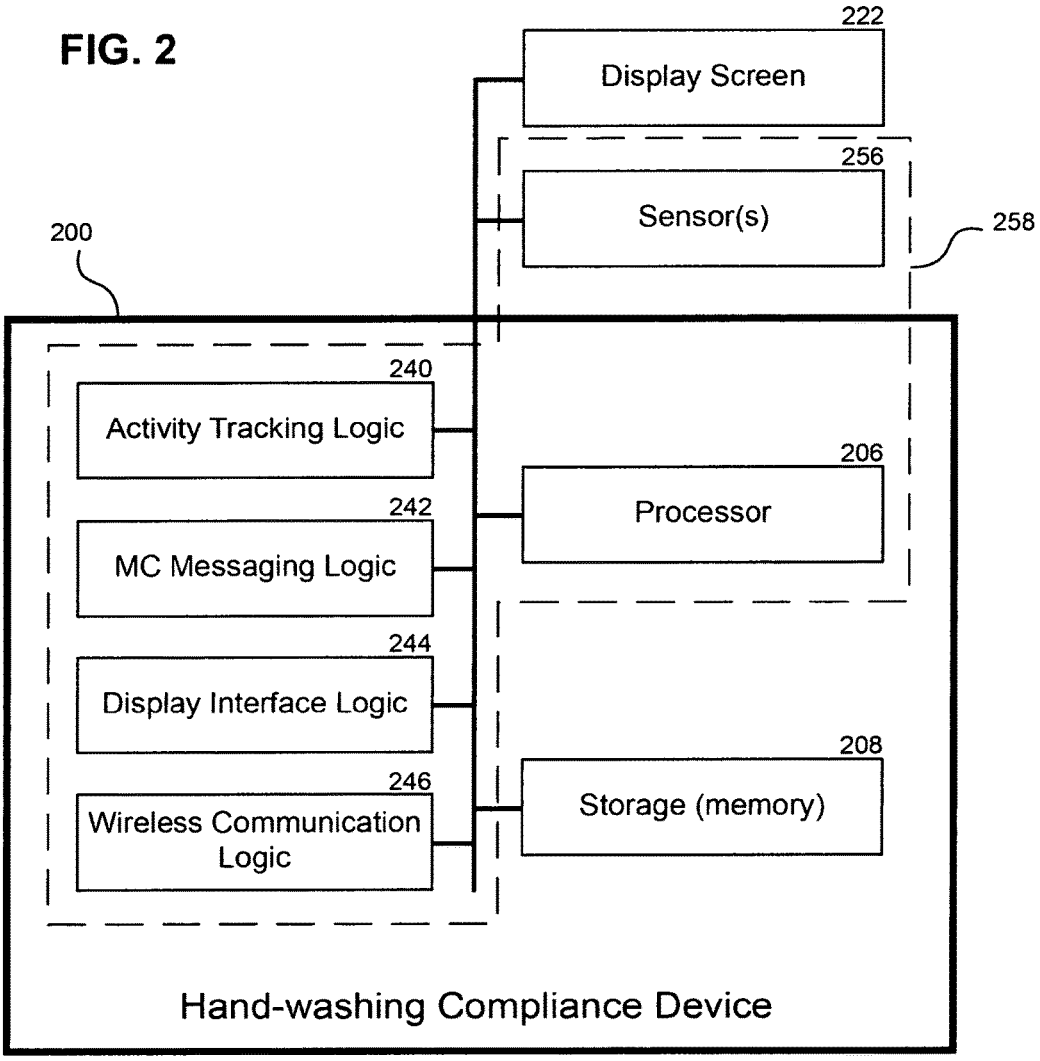
FIG. 2 illustrates an example of a hand-washing compliance device including example components utilized for tracking activity and motion, and associated interfaces to a display screen, in accordance with one embodiment of the present invention.

FIG. 2 illustrates an example of hand-washing compliance device 200 of FIG. 1, showing some additional example components utilized for motion activity, and associated interfaces to display screen 222. In one embodiment, examples of a display screen 222 can include, but are not limited to, liquid crystal display (LCD) screens, light emitting diode (LED) screens, organic light emitting diode (OLED) screens, plasma display screens, etc. (Flexible screens included.)

As shown in FIG. 2, the hand-washing compliance device 200 includes logic 258. Logic 258 may include activity tracking logic 240, motion-controlled messaging logic 242, display interface logic 244, wireless communication logic 246, processor 206, and sensors 256. Additionally, storage (e.g. memory) 208, can be integrated within the hand-washing compliance device 200. The activity tracking logic 240 can include logic that is configured to process usage data of the device 200, such as completed hand-washing cycles, unfinished hand-washing cycles, frequency of cycles, etc.

The display interface logic 244 is configured to interface with the processor and the motion-controlled messaging logic to determine when specific messages will be displayed on the display screen 222 of the hand-washing compliance device 200. The display interface logic 244 can act to turn on the screen, display metric information, display characters or alphanumeric information, display graphical user interface graphics, display images, display videos or combinations thereof.

The wireless communication logic 246 is configured for communication of the hand-washing compliance device with another computing device by way of a wireless signal. The wireless signal can be in the form of a radio signal. As noted above, the radio signal can be in the form of a Wi-Fi signal, a Bluetooth signal, a low energy Bluetooth signal, or combinations thereof. The wireless communication logic can interface with the processor 206 and storage 208 of device 200, for transferring activity data, which may be in the form of motion data or processed motion data, stored in the storage 208 to the other computing device.

In one embodiment, processor 206 functions in conjunction with the various logic components 204, 242, 244, and 246. The processor 206 can, in one embodiment, provide the functionality of any one or all of the logic components. In other embodiments, multiple chips can be used to separate the processing performed by any one of the logic components and the processor 206. Sensors 256 can communicate via a bus with the processor 206 and/or the logic components. The storage 208 is also in communication with the bus for providing storage of the motion data processed or tracked by the hand-washing compliance device 200.

Figure 3:
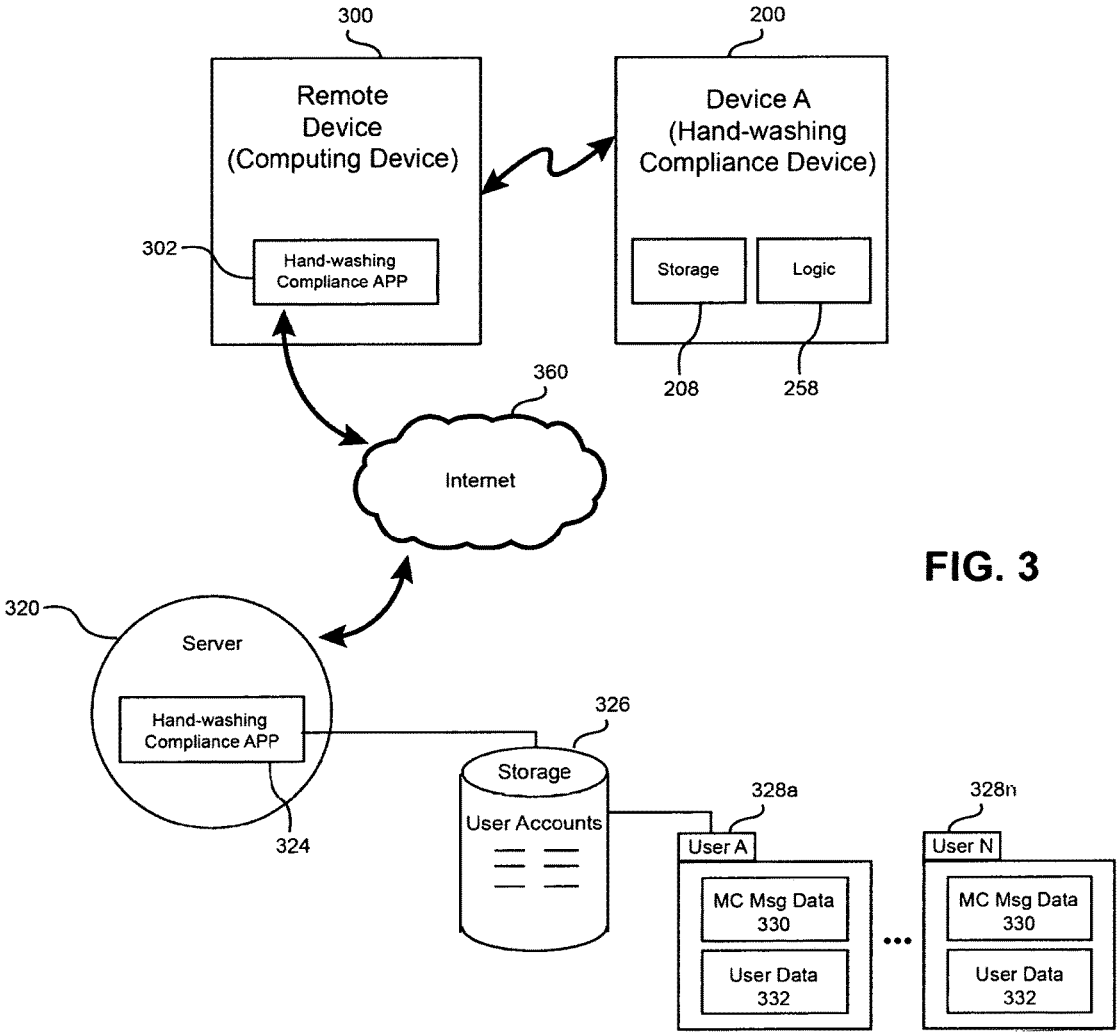

FIG. 3 illustrates an example of hand-washing compliance device 100 in communication with a remote device 300. Remote device 300 is a computing device that is capable of communicating wirelessly with hand-washing compliance device 100 and with the Internet 360. Remote device 300 can support installation and execution of applications. Such applications can include a hand-washing compliance application 302. Hand-washing compliance application 302 can be downloaded from a server. The server can be a specialized server or a server that provides applications to devices, such as an application store. Once the hand-washing compliance application 302 is installed in the remote device 300, the remote device 300 can communicate or be set to communicate with hand-washing compliance device 100 (Device A). The remote device 300 can be a smartphone, a handheld computer, a tablet computer, a laptop computer, a desktop computer, or any other computing device capable of wirelessly interfacing with Device A and the Internet.

In one embodiment, remote device 300 communicates with hand-washing compliance device 100 over a Bluetooth connection. In one embodiment, the Bluetooth connection is a low energy Bluetooth connection (e.g., Bluetooth LE, BLE, or Bluetooth Smart). Low energy Bluetooth is configured for providing low power consumption relative to standard Bluetooth circuitry. Low energy Bluetooth uses, in one embodiment, a 2.4 GHz radio frequency, which allows for dual mode devices to share a single radio antenna. In one embodiment, low energy Bluetooth connections can function at distances up to 50 meters, with over the air data rates ranging between 1-3 megabits (Mb) per second. In one embodiment, a proximity distance for communication can be defined by the particular wireless link, and is not tied to any specific standard. It should be understood that the proximity distance limitation will change in accordance with changes to existing standards and in view of future standards and/or circuitry and capabilities.

Remote device 300 can also communicate with the Internet 360 using an Internet connection. The Internet connection of the remote device 300 can include cellular connections, wireless connections such as Wi-Fi, and combinations thereof (such as connections to switches between different types of connection links). The remote device, as mentioned above, can be a smartphone or tablet computer, or any other type of computing device having access to the Internet and with capabilities for communicating with the hand-washing compliance device 100.

A server 320 is also provided, which is interfaced with the Internet 360. The server 320 can include a number of applications that service the hand-washing compliance device 100, and the associated user of the hand-washing compliance device 100 by way of user accounts. For example, the server 320 can include an hand-washing compliance application 324. The hand-washing compliance application 324 can include logic for providing access to various devices 100, which are associated with user accounts managed by server 320. Server 320 can include storage 326 that includes various user accounts. The user account **328*a* for user A and the user account 328*n*** for user N are shown to include various information.

The information can include, without limitation, data associated with motion-controlled messaging 330, user data 332, etc. As will be described in greater detail below, the motion-controlled messaging data 330 includes information regarding a user's preferences, settings, and configurations which are settable by the user or set by default at the server 330 when accessing a respective user account. It should also be noted that a single user account can have various or multiple devices associated therewith, and the multiple devices can be individually customized, managed and accessed by a user. In one embodiment, the server 330 provides access to a user to view the user data 332 associated with hand-washing compliance device.

The data viewable by the user includes the tracked usage data, which is processed to identify a plurality of metrics associated with the usage data. The metrics are shown in various graphical user interfaces of a website enabled by the server 320. The website can include various pages with graphical user interfaces for rendering and displaying the various metrics for view by the user associated with the user account. In one embodiment, the website can also include interfaces that allow for data entry and configuration by the user.

It should be mentioned that in some embodiments, separate users can be identified. As previously mentioned, sensors can be included for facial recognition. Other methods including, but not limited to, voice recognition, fingerprint scanning, etc. are included.

Broadly speaking, after recognizing a specific user, a user profile may be included to personalize the experience of the hand-washing compliance device. Furthermore, multiple user profiles can be established using the same account associated to the hand-washing compliance device.

Figure 4B:
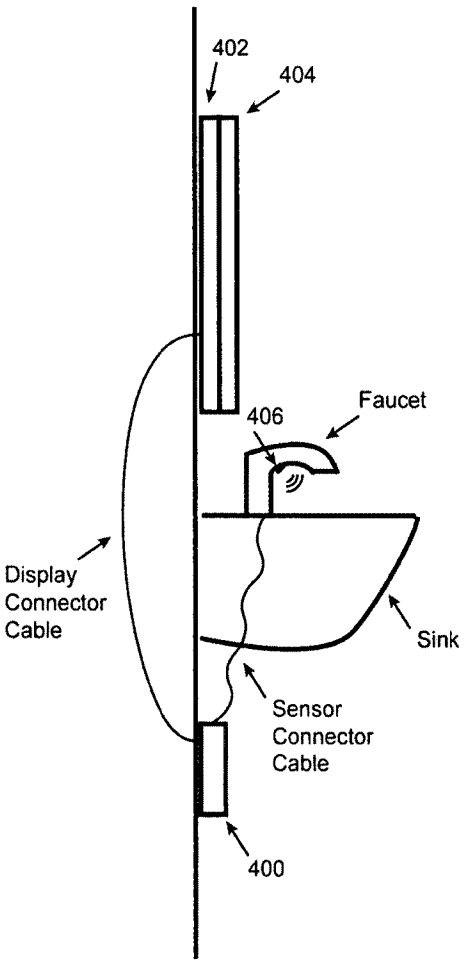
FIG. 4B illustrates a side view of a hand-washing compliance device, in accordance with an embodiment of the invention.
Figure 4A:
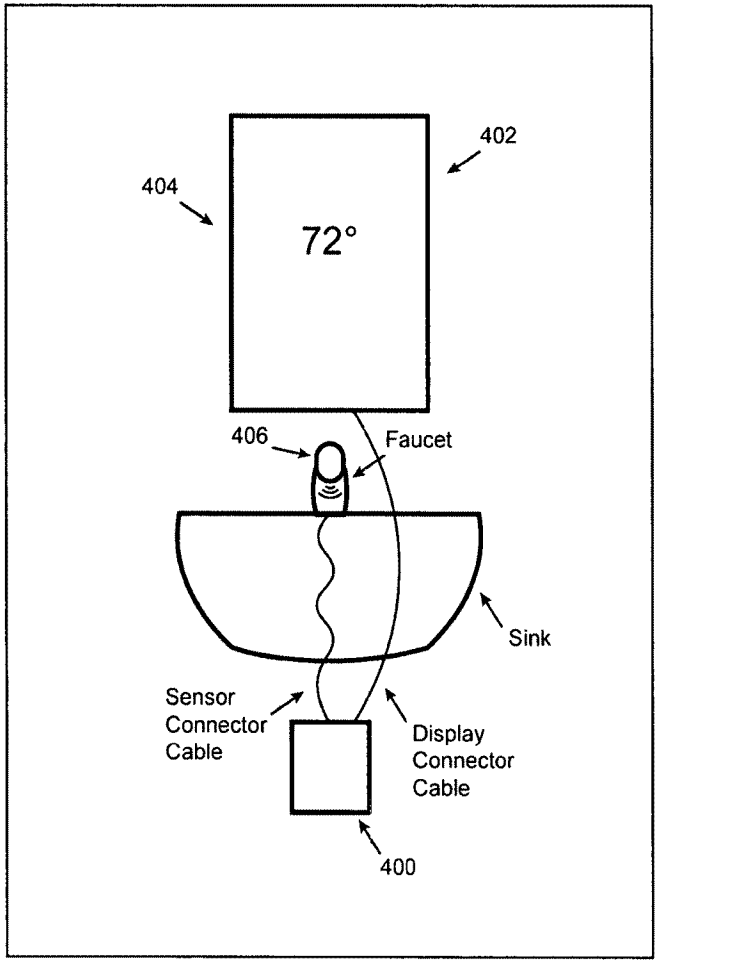
FIG. 4A illustrates a perspective view of a hand-washing compliance device, in accordance with an embodiment of the invention.

FIG. 4A illustrates a perspective view of a portable hand-washing compliance device, in accordance with an embodiment of the invention. The hand-washing compliance device 400 is shown to connect to a display 402 for displaying various data such as text, images, or video. In the illustrated embodiment, the display 402 is currently displaying the weather, indicating the degrees for the particular day according to a weather API. Mounted in front of the display 402 is a mirror 404. In the illustrated embodiment, the mirror 404 serves to allow visibility to the display 402 while remaining a reflective surface for the user to see him or herself. In one embodiment, examples of a mirror 404 can include, but are not limited to, 1-way mirrors, 2-way mirrors, etc. In one embodiment, the mirror 404 or any surface containing a sensor may be pressed to interact with the interface. In the illustrated embodiment, sensor 406 is used to interact with the interface via non-physical contact. Sensor 406 is attached to a faucet and directed downward at the bowl of the sink to detect the motion a user creates while washing their hands. The sensor 406 continuously detects motion so that in response to detecting predefined amounts of motions, a number of actions can be executed. Actions include, but are not limited to, turning the display on/off, adding/subtracting/manipulating messages on the display, adding/subtracting/manipulating parameters of messages on the display, etc.

It should be noted that the power source for the display 402 and the hand-washing compliance device can be separate. In the illustrated embodiment, the power for the hand-washing compliance device 400 and display 402 are supplied by a power cable to a power outlet. In one embodiment, the hand-washing compliance device 400 and display 402 may include a battery for power.

In some embodiments, additional actions that may be of use to a user may be accessed by pressing a button on the hand-washing compliance device 400, such as a pairing mode for pairing the hand-washing compliance device to an external device, an option to reset an activity counter, an option to turn the device off, etc. It should be appreciated that the button may be pressed in various ways to facilitate access to various features. By way of example, the button may be pressed once, pressed and held, pressed twice in rapid succession, etc. For example, pressing and holding the button may turn the device 400 on or off.

FIG. 4B illustrates a side view of the hand-washing compliance device 400, in accordance with an embodiment of the invention.

Figure 5:
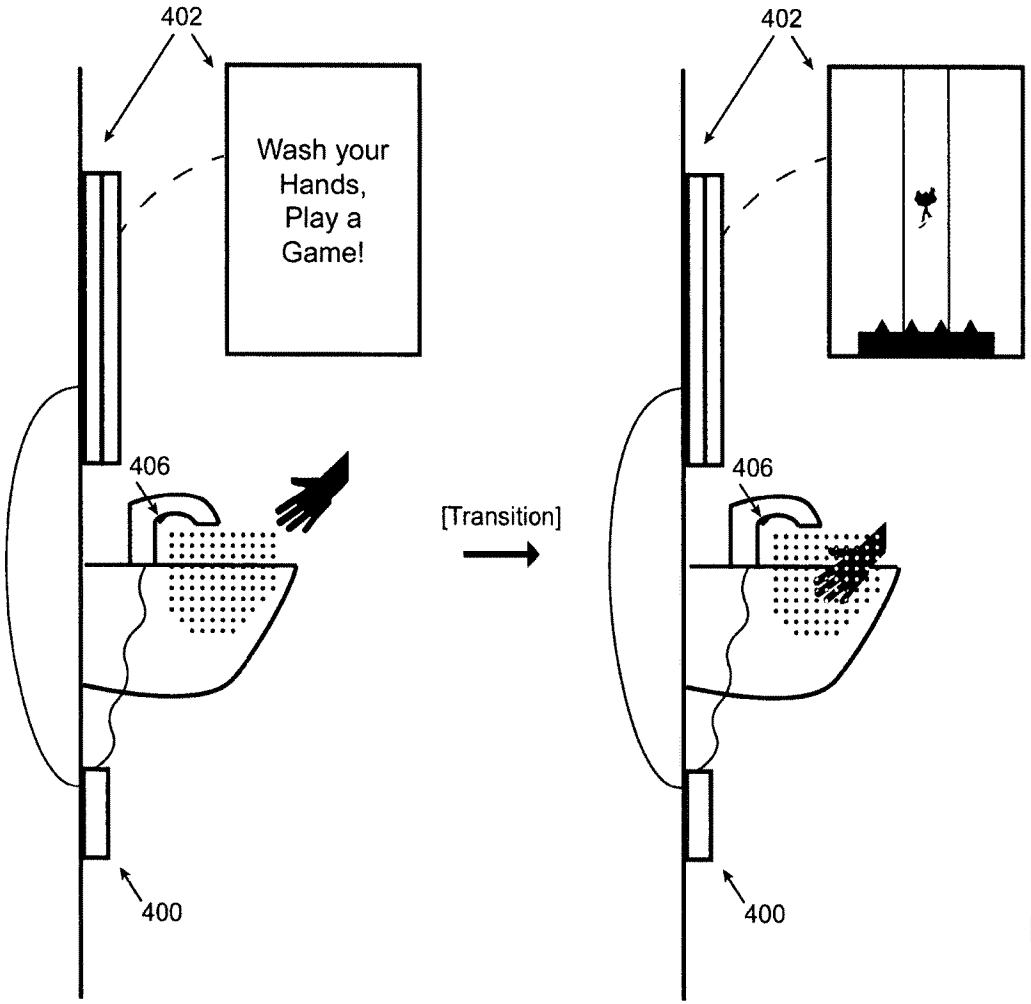
FIG. 5 conceptually illustrates a motion-controlled message on a display connected to a hand-washing compliance device and the transition of detecting motion from a motionless environment, in accordance with an embodiment of the invention.

FIG. 5 conceptually illustrates the display of a motion-controlled message on a display connected to the hand-washing compliance device and the transition of detecting motion from a motionless environment, in accordance with an embodiment of the invention. In one embodiment, a message can be displayed on the display 402 of the hand-washing compliance device 400 in response to the detection of a motion by the sensor(s) of the device 400 from a motionless environment.

The motionless environment can be defined by determining an absence of motion within the detection range of the hand-washing compliance device's motion sensor(s) for a predefined time period. For example, in one embodiment, the motionless environment requires the sensor(s) of the device to detect an absence of motion for approximately two to three seconds. In other embodiments, the motionless environment is defined to require the sensor(s) of the device to detect an absence of motion for any specified length of time.

Furthermore, it will be appreciated that the motionless environment may be defined by the absence of motion exceeding a predefined threshold for a specified length of time. It should be appreciated that the specific types of motions and the predefined threshold can be defined in various ways. For example, in one embodiment, the motion is defined by the sensor output of motion-sensitive hardware included with the hand-washing compliance device, such as infrared sensors, video motion sensors, gyroscopes, etc., and the predefined threshold may be defined by a specific magnitude of a given sensor output (e.g. detected motion exceeds an motion threshold). It will be appreciated that a combination of sensor outputs and corresponding thresholds can be considered. In one embodiment, a weighted combination (e.g., a weighted sum) of motion sensor outputs is defined and compared against a predefined threshold. In this manner, certain types of motions may be prioritized over others for purposes of identifying movement from a motionless environment. For example, in one embodiment, rotational movement of the faucet handle (containing a gyroscope sensor) is prioritized over motion detected in the bowl of the sink, such that sensor outputs which are indicative of rotational movement of the faucet handle are more highly weighted than sensor outputs which are indicative of motion in the bowl of the sink.

In other embodiments, the detected motion and corresponding predefined threshold can be defined based on particular types of motion which are determined or derived from motion sensor output. For example, in one embodiment, motion is determined, and the device detects a motionless environment so long as the motion created does not exceed a predefined motion threshold. In one embodiment, the detection of the motion is reset following a period of zero motion. In another embodiment, the detection of the motion created is cumulative. By defining the motionless environment based on the absence of motion exceeding a predefined threshold, false positive motion can be avoided, so that motion-controlled messages are not displayed or controlled when the movements are of low significance or unlikely to be the result of intentional motion warranting display or control of a motion-controlled message.

Thus, in accordance with the foregoing, a motion-controlled message can be displayed when the following events are determined: an absence of motion detected by the sensor(s) of the device; maintenance of an absence of motion for a minimum specified length of time; and, following the maintenance of an absence of motion, motion detected by the sensor(s) of the hand-washing compliance device (e.g. rotational movement). The completion of the preceding events can be configured to trigger presentation of a motion-controlled message on the display 402 of the hand-washing compliance device 400.

As shown with continued reference to FIG. 5, the hand-washing compliance device 400 is determined to be in a motionless environment for at least a predefined length of time. During the motionless environment a motion-controlled message is presented ("Wash your hands, play a game!") on the display 402. Following which the user places their hands within the sensor's detection field. Upon detecting the motion created by the user placing their hands into the detection field, the motion-controlled message ceases to be displayed; and in one embodiment, a motion-controlled message, such as a video game where a monkey is climbing up a tree to escape a wood chipper, is presented on the display 402.

Figure 6:
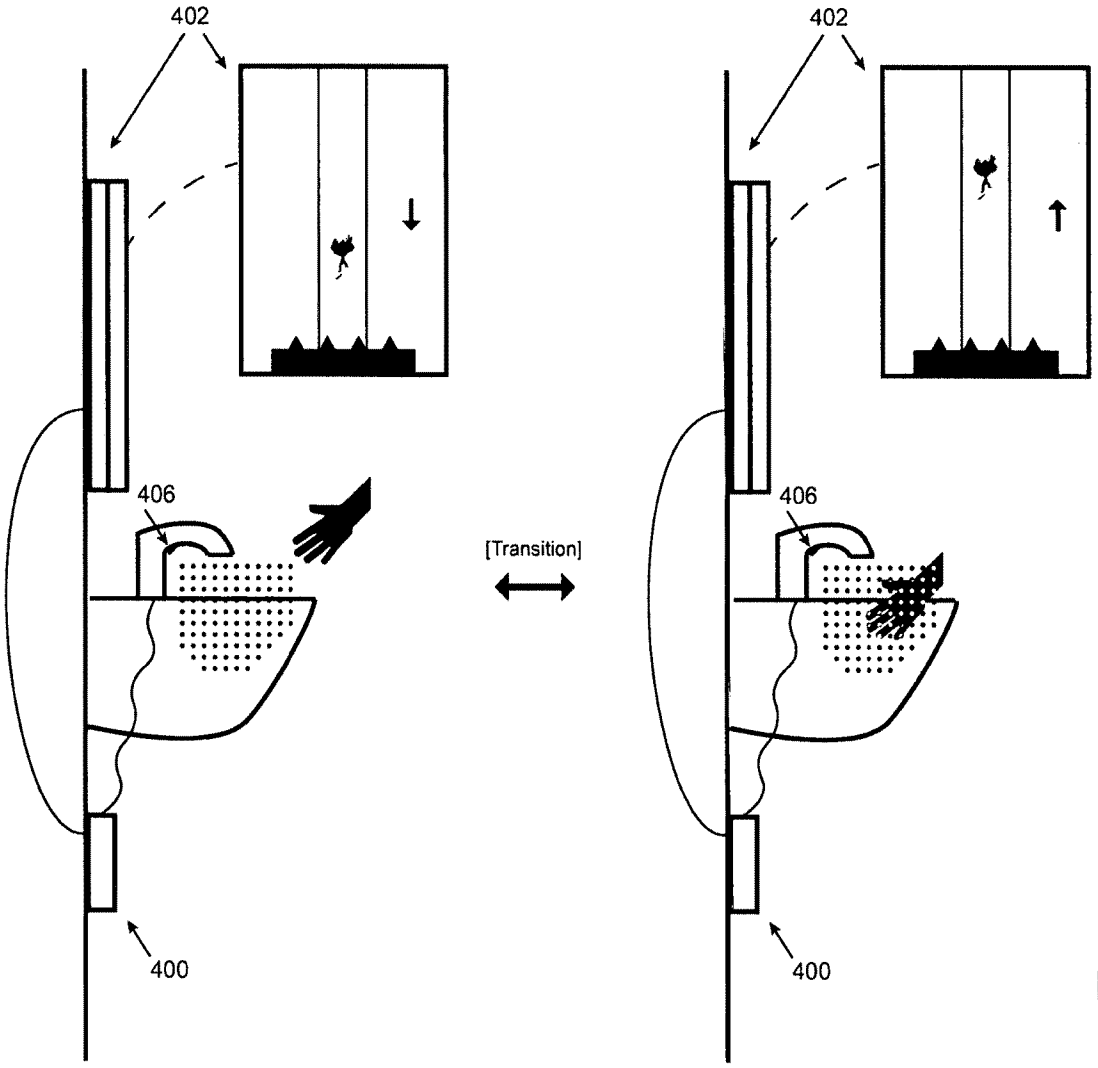
FIG. 6 conceptually illustrates the way by which a user controls a motion-controlled message on a display connected to the hand-washing compliance device, in accordance with an embodiment of the invention.

FIG. 6 conceptually illustrates the way by which a user controls a motion-controlled message on a display connected to the hand-washing compliance device, in accordance with an embodiment of the invention. Continuing with the video game example message of FIG. 5, during the time the video game message is present the motion detected by the sensor(s) determines the rate by which the monkey climbs up the tree. If insufficient motion is detected, the monkey will climb up the tree at a slower rate than the wood chipper, endangering the monkey. On the contrary, if there is sufficient motion created by the user while washing their hands, the monkey will climb up the tree at a faster rate than the wood chipper, preventing harm from befalling the monkey.

In one embodiment, a message may be defined by any data presented by the display 402 connected to the hand-washing compliance device, including but not limited to, text, image(s), video(s), or any combination thereof. In one embodiment, a message may be defined by audio presented by an audio device associated with the hand-washing compliance device. As previously mentioned, in one embodiment, motion detected can control the parameters of messages on display 402. By way of example, in one embodiment, a user controls the rate by which the video message will play by washing, or not washing, their hands in the sink. By way of another example, in one embodiment, a user controls the position of an image by washing, or not washing, their hands in the sink. By way of yet another example, a user controls the amplitude of audio by washing, or not washing, their hands in the sink. Therefore parameters of messages include, but are not limited to, position, speed, amplitude, etc.

Figure 7:
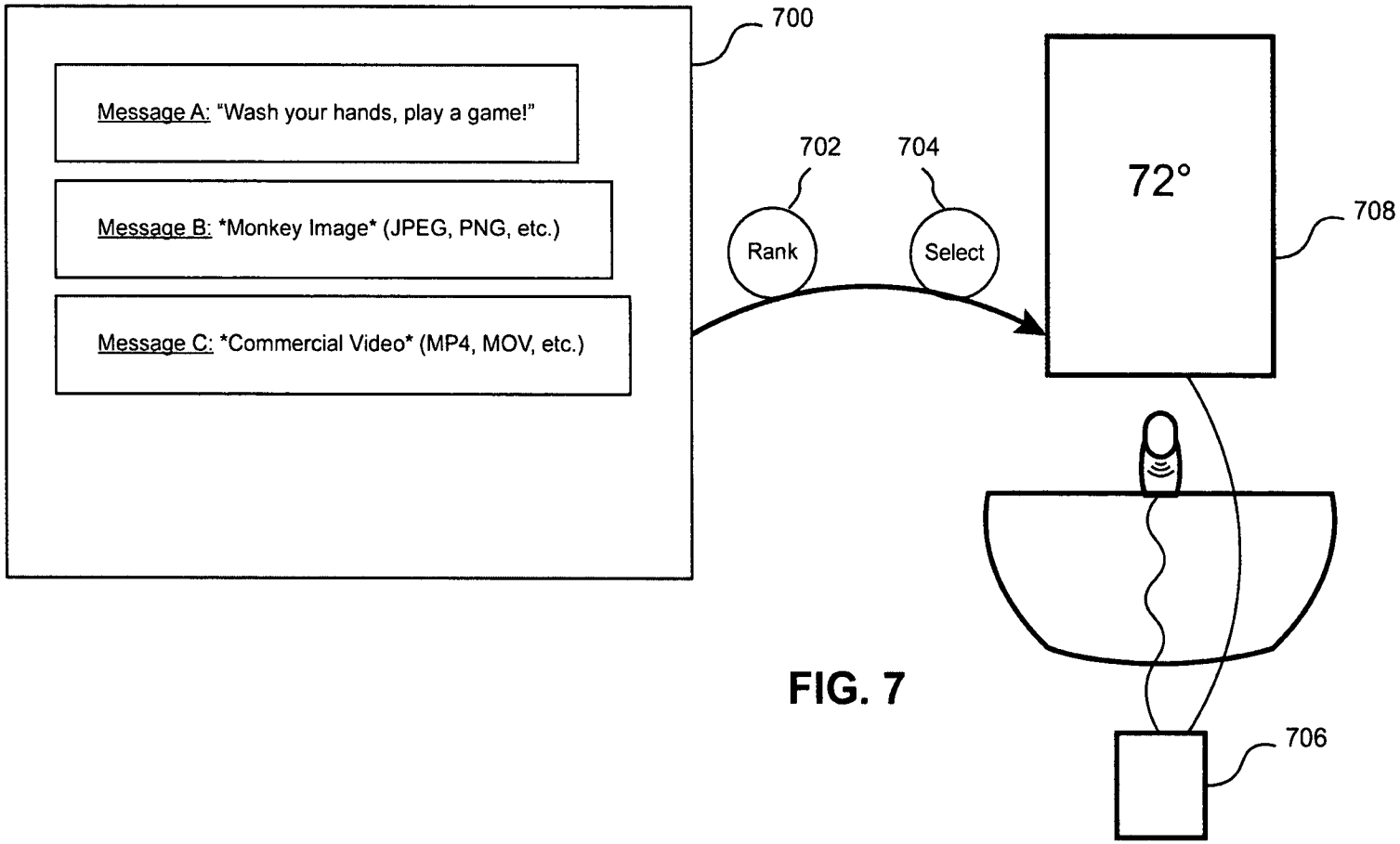
FIG. 7 conceptually illustrates a process for displaying a motion-controlled message on a display connected to a hand-washing compliance device, in accordance with an embodiment of the invention.

FIG. 7 conceptually illustrates a process for displaying a motion-controlled message on a display connected to a hand-washing compliance device, in accordance with an embodiment of the invention. In one embodiment, a plurality of motion-controlled messages 700 are stored on the hand-washing compliance device 706. In the illustrated embodiment, the messages 700 include various Messages A, B, C, etc. Each message defines a portion of text, image(s), or video(s) presentation on the display 708 of the hand-washing compliance device 706. By way of example, Message A is defined by the text "Wash your hands, play a game!"; Message B is defined by the image *Monkey Image*; etc.

To determine which one of the messages 700 to display, the messages 700 may be ranked (ref. 702) based on various factors, including without limitation, time/date, prior display, activity/inactivity of the user as detected by the device 706, etc. Additional exemplary factors which may be utilized to rank, or otherwise determine selection from, a plurality of messages, are discussed in further detail below. As indicated at ref. 704, one of the messages is selected for display, based at least in part on the determined ranking. The selected message is displayed on the display 708 of the hand-washing compliance device 706. It will be appreciated that the presentation of the selected message may be scrolled across the display 708 if the length of the selected message is too long to permit the entirety of the selected message to be displayed simultaneously.

Figure 8:
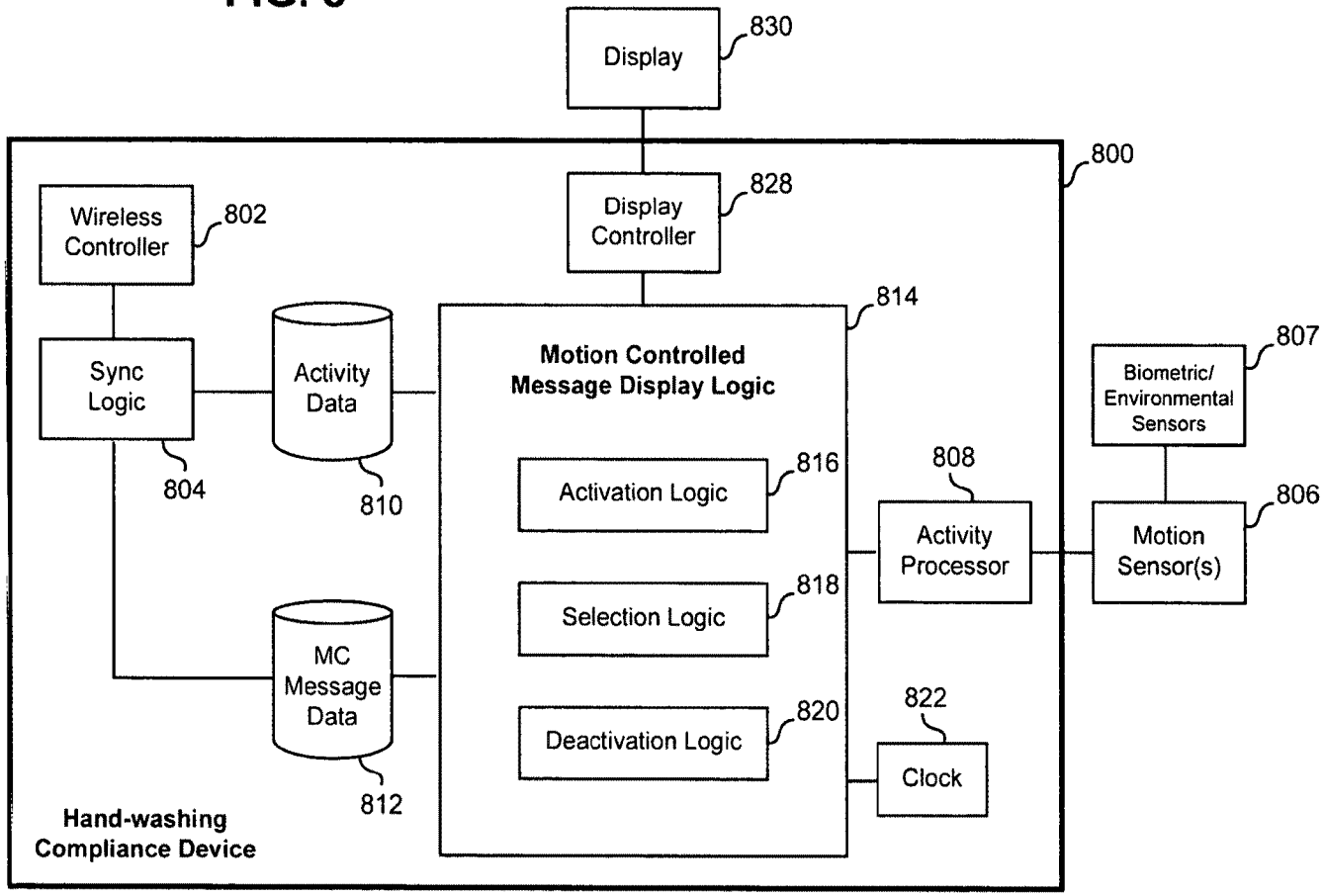
FIG. 8 conceptually illustrates components of a hand-washing compliance device, in accordance with an embodiment of the invention.

FIG. 8 conceptually illustrates components of a hand-washing compliance device, in accordance with an embodiment of the invention. As shown, the hand-washing compliance device 800 is defined to include motion sensors 806, which may include, without limitation, accelerometers, gyroscopes, infrared sensors, video motion sensors, motion sensitive contact switches, or other motion-sensing hardware. Additionally, the device 800 can include other biometric/environmental sensors 807. An activity processor 808 processes sensor output data generated by the sensors 806 and 807 to determine activity by the user, such as an average motion per second, periods of activity or inactivity, etc. These activity data are stored in an activity data storage 810. It will be appreciated that raw sensor data can also be stored for later processing.

The device 800 further includes a motion-controlled message data storage 812 which contains message data defining various messages that can be presented based on motion detected by the sensors 806 following a determined motionless environment. Motion-controlled message display logic 814 is configured to determine when to display a motion-controlled message as well as the particular message that is displayed. The motion-controlled message display logic 814 includes activation logic 816. In one embodiment, the activation logic 816 is configured to identify, based on sensor data received from the motion sensors 806, motion or an absence thereof to or from the motionless environment.

The activation logic 816 determines when the sensors 806 detect an absence of motion for a specified minimum period of time. By way of example, the specified minimum period of time may be defined as a value in the range of 2 to 5 seconds, 5 to 10 seconds, 10 seconds to 1 min, 1 to 10 min, or any other defined period of time. In one embodiment, the specified minimum period of time may be determined based on a user-defined setting. In yet another embodiment, the specified minimum period of time may vary depending upon various factors, such as time of day, the amount of activity or inactivity recently associated with the device 800, etc.

When the activation logic 816 determines an absence of motion maintained for the requisite minimum period of time, then the activation logic 816 is configured to detect subsequent motion from the motionless environment, based on sensor data from the motion sensors 806. Upon such detection of motion, the activation logic is configured to trigger selection and display the selected motion-controlled message(s) on the display 830.

In various embodiments, it will be appreciated that the activation logic 816 can be configured to consider other factors or purposes of determining when to trigger selection and display of a motion-controlled message. For example, a user interacting with the device 800 may place an object within the detection field of the sensors 806 while the display is still active. A timer can be configured to automatically turn off the display after a given amount of time in which interactivity with the display is not detected (e.g. insufficient motion detected by the sensors 806). Thus in one embodiment, the activation logic 816 is configured to determine a current active or inactive state of the display 830, and does not commence its procedure for determining when to trigger the motion-controlled message unless the display is currently inactive or turned off.

In another embodiment, the activation logic 816 will not commence its activation procedure unless ambient light levels detected by the device 800 are above a predefined threshold. This may prevent the unnecessary display of a motion-controlled message when the sensors 806 of the device 800 are in a dark location, such as when the lights are off in a facility, by way of example.

When the activation logic 816 determines that a motion-controlled message is to be displayed, as discussed above, then selection logic 818 is engaged to select a message from the message data storage 812 for presentation. The selection logic 818 can be configured to select the message based on a variety of factors as discussed elsewhere herein. By way of example, the device 800 includes a clock 822, which provides a current date and time, which may be utilized by the selection logic 818 to determine which message to present. In one embodiment, the selection logic 818 determines a ranked order for a plurality of messages stored in the message data storage 812, and identifies a specific message for presentation based on the ranked order. The motion-controlled message display logic 814 is configured to render the selected message on the display 830 of the device 800 via a display controller 828.

The motion-controlled message display logic 814 further includes deactivation logic 820 which is configured to deactivate the operation of the display logic 814 under certain conditions. The display of a motion-controlled message can be terminated in response to different types of interaction or the lack thereof. For example, a motion-controlled message may be configured to be displayed for a limited amount of time, whereupon if no additional interaction with the sensors 806 is detected, then rendering of the motion-controlled message is terminated, and the display is turned off. In such an embodiment, the deactivation logic 820 can be configured to include a timer that is activated when a motion-controlled message is rendered by the display logic 814. Upon the expiration of the timer, then the display of the motion-controlled message is stopped. In a related embodiment, upon the expiration of a limited amount of time, the display of the motion-controlled message is ended and replaced with display of other information automatically, such as a current time, activity metric, or any other information which the device 800 may be configured to display.

The device 800 also includes synchronization logic 804 which is configured to handle synchronization of data with another device or with a remote server or cloud-based service. The hand-washing compliance device 800 is configured to wirelessly transmit and receive data, with wireless communications being handled by a wireless controller 802. Synchronization logic 804 is configured to upload activity data from the activity data storage 810. The synchronization logic 804 is also configured to download motion-controlled message data from a remote storage location to the motion-controlled message data storage 812. In this manner, the synchronization logic 804 updates the messages which are stored in the message data storage 812. It should be appreciated that the synchronization logic 804 may also be configured to effect deletion of messages from the motion-controlled message data storage 812.

Figure 9:
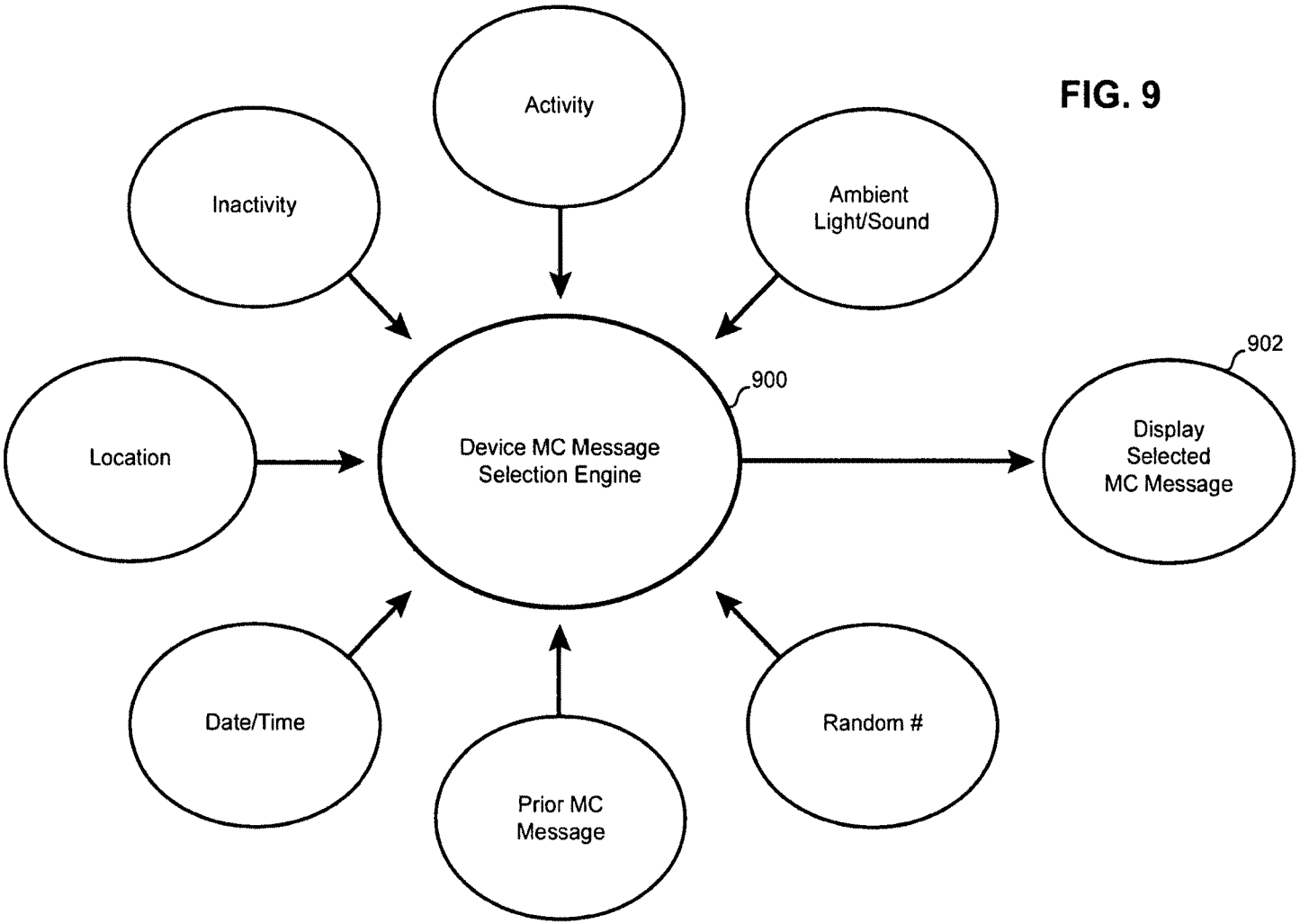
FIG. 9 conceptually illustrates selection of a motion-controlled message on a hand-washing compliance device based on a variety of factors, in accordance with an embodiment of the invention.

FIG. 9 conceptually illustrates selection of a motion-controlled message on a hand-washing compliance device based on a variety of factors, in accordance with an embodiment of the invention. In the illustrated embodiment, a device motion-controlled message selection engine 900 is shown. The message selection engine 900 is configured to select a message for display on a hand-washing compliance device (ref. 902) in response to detection of motion to or from a predefined motionless environment.

In one embodiment, a message may be selected based on a current time of day. For example, a message such as "good morning" may be selected when the current time is in the morning. A message may also be selected based on the current date or day of the week. For example, a message such as "TGIF" may be selected on a Friday. In another embodiment, a message may be selected based on a current location of the device. For example, if the user is in the city of San Francisco, then a message may be configured to welcome the user with news of the area, such as "San Francisco is hot right now!"

In one embodiment, a message may be selected based on the activity of a user as determined via the hand-washing compliance device. For example, if the user has recently completed a game for the first time, then a message may be selected congratulating the user on having finishing the game message. A message may also be selected based on the inactivity of the user is determined by the hand-washing compliance device. For example, if the device has been resting without motion being detected for an extended period of time, then a message may be selected that is configured to encourage the user to engage in further activity or otherwise engage with the device, such as "Keep washing!"

In one embodiment, a message may be selected at random, or based on a random number. In another embodiment, a message may be selected based on prior message selection, so as to avoid displaying the same message to the user in a relatively short time span.

In some embodiments, a message may be selected for display based on various sensed conditions. For example, a message may be selected based on an environmental condition which the hand-washing compliance device is capable of detecting, such as ambient light, ambient sound, etc.

Figure 10:
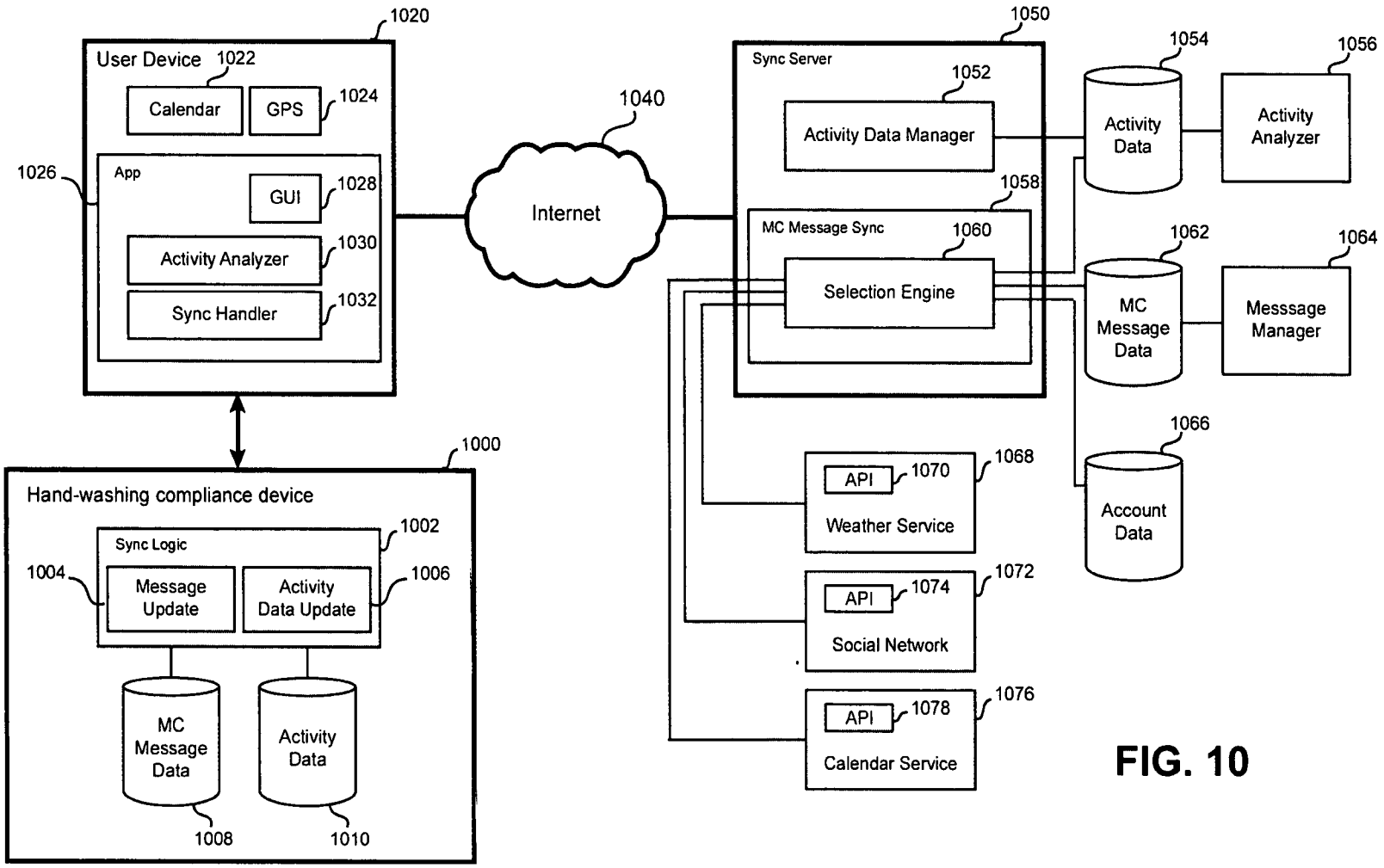
FIG. 10 conceptually illustrates a system for determining a motion-controlled messages to be presented on a hand-washing compliance device, in accordance with an embodiment of the invention.

FIG. 10 conceptually illustrates a system for determining motion-controlled messages to be presented on a hand-washing compliance device, in accordance with an embodiment of the invention. A hand-washing compliance device 1000 is shown to include synchronization logic 1002. The synchronization logic 1002 includes a message update module 1004 that is configured to update motion-controlled message data that is stored in a motion-controlled message data storage 1008. The synchronization logic 1002 further includes an activity data update module 1006 that is configured to manage activity data stored in the activity data storage 1020, including uploading of activity data as well as deletion of activity data in accordance with the embodiments described herein.

The hand-washing compliance device 1000 communicates to a user device 1020, that in turn communicates with a remote server 1050 via a network 1040. The user device 1020 may be a mobile device or any other type of computing device capable of performing the functionality described herein. In the illustrated embodiment, the user device 1020 includes a calendar module 1022 that is configured to maintain a personal calendar of the user. The calendar may be synchronized to a cloud-based calendar service 1076, which may be accessed via a calendar API 1078. Additionally, the user device 1020 includes a GPS module 1024 that is configured to determine a geo-location of the user device 1020.

The user device 1020 includes an application 1026, which may be a browser or a dedicated application that is configured to interface with the hand-washing compliance device 1000 as well as the server 1050. The application 1026 defines a graphical user interface 1028 through which the user may control the operation of the application 1026. The application 1026 further defines an activity analyzer 1030 which is configured to analyze activity data received from the hand-washing compliance device 1000. A synchronization handler 1032 is configured to handle synchronization operations between the hand-washing compliance device, the user device 1020, and cloud-based data storage accessed via the server 1050. For example, the sync handler 1032 may communicate with the activity data update module 1006 defined by the sync logic 1002 of the hand-washing compliance device 1000 in order to facilitate uploading of activity data from the hand-washing compliance device 1000 to the user device 1020. The uploaded activity data may be further processed by the activity analyzer 1030, and/or may be transmitted via network 1040 to an activity data manager 1052 of the server 1050, for storage in a cloud-based activity data storage 1054. An activity analyzer 1056 of the cloud-based system is configured to analyze the activity data stored in the activity data 1054, and may generate additional activity data that are also stored in the activity data storage 1054.

The server includes a motion-controlled message synchronization module that is configured to select messages and download them to the hand-washing compliance device. The downloading of selected messages is mediated by the sync handler 1032 of the user device 1020, with which a message update module 1004 of the hand-washing compliance device 1000 communicates to receive message data for storage in the message data storage 1008. In other words, the message data is transferred from the server 1050 to the user device 1020, and the user device 1020 in turn transfers the message data to the hand-washing compliance device for storage. In this manner, the motion-controlled message data on the hand-washing compliance device is updated by the remote server 1050. It should be appreciated that the transfers of the message data may occur in immediate succession when the user device 1020 is simultaneously connected to both the server 1050 and the hand-washing compliance device 1000. However, when the user device 1020 is not connected to the hand-washing compliance device 1000, then message data may be transferred by the server 1050 to the user device 1020 and temporarily stored at the user device 1020 until the hand-washing compliance device is connected to the user device 1020, at which time the message data may then be transferred to the hand-washing compliance device 1000.

In addition to transfers of message data defining specific motion-controlled messages to the hand-washing compliance device 1000, the motion-controlled message synchronization module 1058 of the server 1050 may additionally be configured to effect other changes to the message data stored at the hand-washing compliance device 1000. For example, commands or updates may be sent to the hand-washing compliance device 1002 to manage the message data stored in the message data storage 1008. Examples of such commands or updates include, without limitation, deletion of messages, modification of messages, changes to metadata associated with messages, etc.

In the illustrated embodiment, the message synchronization module 1058 includes a message selection engine 1060 that is configured to select one or more messages to be transferred to the hand-washing compliance device 1000. A plurality of messages that are available for selection are stored in a message data storage 1062. A message manager 1064 is provided for managing the messages stored in the message data storage 1062. In one embodiment, the message manager 1064 provides an interface whereby an editor may create new messages, or edit or delete existing messages.

The selection engine 1060 is configured to select messages based on a variety of factors. By way of example, selection engine 1060 can be configured to identify selected messages based on activity data that is associated with the hand-washing compliance device 1000, as stored in the activity data storage 1054. Such activity data can include various metrics and other types of data which are determined based on the monitored activity of the hand-washing compliance device 1000. The selection engine 1060 may also select messages based on the user account associated with the hand-washing compliance device 1000. In the illustrated embodiment, the user account may be defined in an account data storage 1066. By way of example and not limitation, a user account may define various pieces of information about a given user, such as the user's residence, preferences, etc. The user account can include a historical activity profile of the account based on the user activity data and metrics. In this manner, different messages may be selected based on, for example, whether the user is historically more inactive or more active.

It will be appreciated that activity data may be defined by values, levels, metrics, etc. of particular activities which are associated to specific times or time periods. The activity data which are recorded over time can therefore define an activity history for a given user account. It is noted that the granularity of such time associations may vary in accordance with the specific activity being tracked or other considerations such as a predefined goal or, a predefined threshold for defining or triggering a motion-controlled message. As one example of an activity whose levels may be defined with varying time-associated granularity, consider that a total number of successful video game messages might be determined on a per hour basis, per day, per week, per month, etc. Furthermore, a predefined threshold might be defined so that a motion-controlled message is defined or triggered (i.e. selected or cued for motion-activated display) when the user achieves a given number of completions in a given time period (e.g. x number of completions in a day). It should be understood that similar concepts may be applied for any other activity discussed herein.

Thus in some embodiments, an activity history for a given user can define levels of activity that are associated to specific time periods, as determined from data recorded by a given hand-washing compliance device to which the user account is associated. Motion-controlled messages can be defined and/or triggered based on the activity history of the user account. In this manner, the motion-controlled messages that are presented to the user are customized to the user's account activity history, thereby providing a personalized experience the user.

In one embodiment, the selection engine 1060 is configured to identify selected messages for transfer to the hand-washing compliance device 1000 based on current or predicted weather information. The weather information can be obtained from a weather service 1068, via an API 1070 according to which weather information is made available.

In one embodiment, the message selection engine 1060 is configured to identify selected messages based on social network data that is associated with the user of the hand-washing compliance device 1000. In the illustrated embodiment, the social network data can be obtained from a social network service provider 1072 via an API 1074. By way of example, social network data can include activity of the user on the social network, such as posts or comments, as well as information relating to the social graph of the user on the social network, such as identified friends of the user from the user social graph and their activity on the social network.

In one embodiment, the selection engine 1060 is configured to select messages based on calendar events that are associated with the user of the hand-washing compliance device 1000. In order to determine calendar events, a calendar service 1076 may be accessed via an API 1078. The calendar service 1076 is configured to maintain a calendar associated with the user that defines various events and their dates/times.

Though in the foregoing description, the hand-washing compliance device 1000 is shown to communicate with a user device 1020, which in turn communicates with the server 1050 over a network 1040, in other embodiments, some or all of the functionality defined by the user device 1020 may be included in or otherwise performed by the hand-washing compliance device 1000. Thus, in such embodiments, the hand-washing compliance device itself may communicate directly with the server 1050 over the network 1040 in order to perform data synchronization and other operations such as downloading selected messages to the hand-washing compliance device 1000, as has been described.

Figure 11:
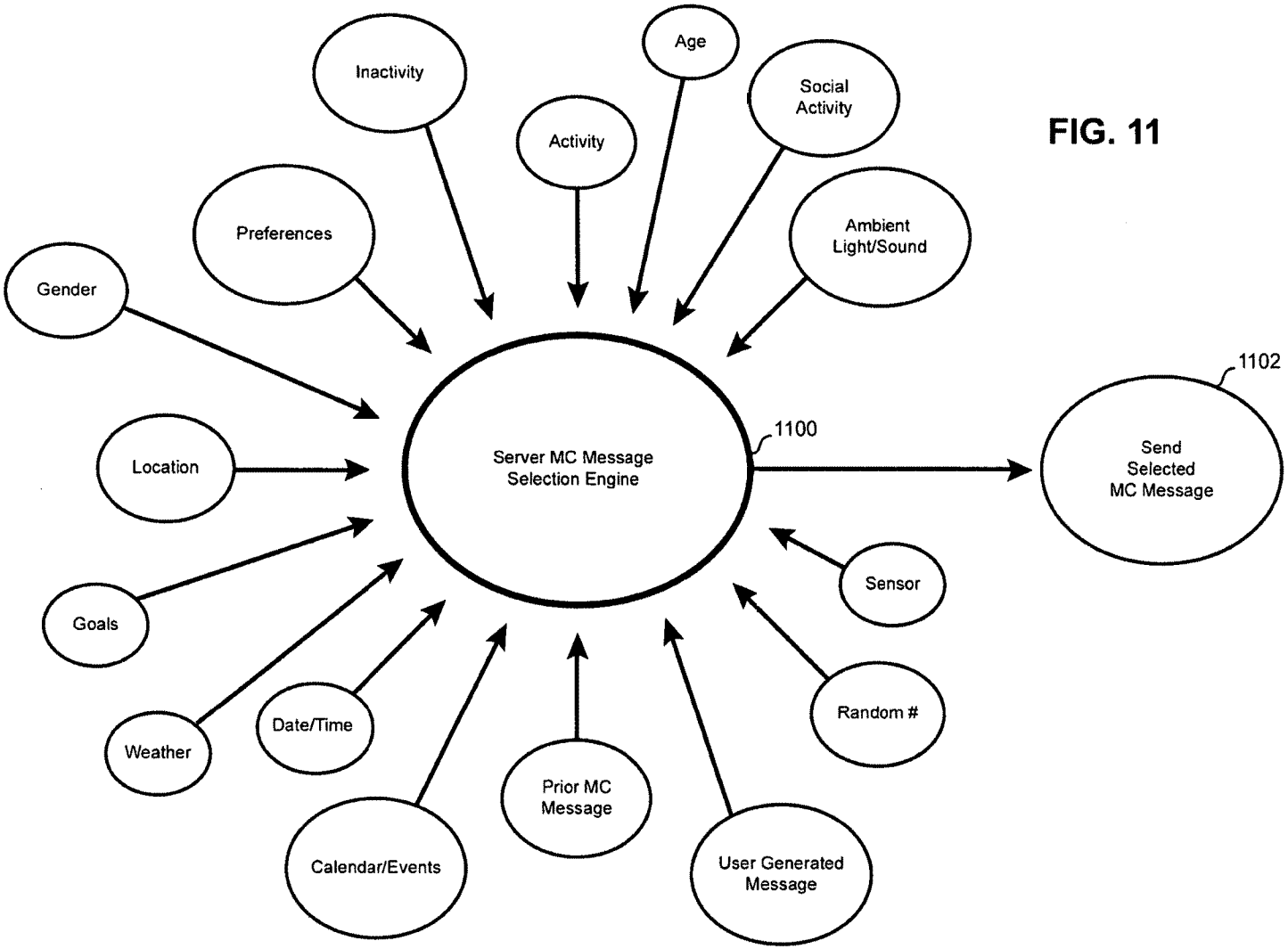
FIG. 11 conceptually illustrates various factors which may be considered for purposes of selecting one or more messages to be sent to a hand-washing compliance device for display in response to motion activation, in accordance with an embodiment of the invention.

FIG. 11 conceptually illustrates various factors which may be considered for purposes of selecting one or more messages to be sent to a hand-washing compliance device for display in response to motion activation, in accordance with an embodiment of the invention. In the illustrated embodiment, a server-side motion-controlled message selection engine 1100 is configured to select messages based on various factors or inputs. The selected messages are sent to a hand-washing compliance device (ref. 1102).

In one embodiment, the selection engine 1100 is configured to identify messages for selection based on demographic data associated with a user of the hand-washing compliance device, such as age, gender, ethnicity, medical conditions, etc. For example, age-appropriate messages may be selected based on the user's age. In one embodiment, the selection engine 1100 is configured to select messages based on an identified location of the user. The location can be defined to varying degrees of specificity, such as by identifying a country, state, city, address, landmark, business, GPS coordinates, or other information which defines a location of the user. The location can be a current location of the user, or another location associated with the user account, such as a residence or work address. By way of example, messages in the appropriate language may be provided based on location information. Or messages may reflect aspects of the locality of the user. For example, if the user is determined to be located at an airport, then a message may be selected which encourage the user to have a safe flight.

In one embodiment, the selection engine 1100 is configured to select messages based on preferences or settings which are associated to the user account. These may include, without limitation, metric preferences such as which time metrics the user prefers, activity interests associated with the user, etc.

In one embodiment, the selection engine 1100 is configured to select messages based on goals which may be user-defined goals or system-identified milestones. For example, a message may congratulate the user on achieving a goal, or encourage a user to perform activity in furtherance of a goal/milestone. Examples of goals include, without limitation, completing a video game, watching an advertisement, etc.

In one embodiment, the selection engine 1100 is configured to select messages based on events stored in a calendar associated with the user. For example, such a message may be configured to remind the user about an upcoming calendar event, ask the user about a current or prior event, etc.

In one embodiment, the selection engine 1100 is configured to select messages based on activity or inactivity of the user, as detected by the hand-washing compliance device. For example, if the user has been very active recently, then a selected message may congratulate the user on the activity, or encourage the user to wash appropriately. If the user has been rather inactive recently, then a selected message may encourage the user to engage in further activity.

In one embodiment, the selection engine 1100 is configured to select messages based on the current or predicted weather. For example, a message may recommend clothing or accessories which are appropriate for the day's weather (e.g. hat/sunglasses for sunshine, umbrella for rain, gloves/scarf for cold weather), recommend activities based on the weather (e.g. "it's a nice day for a walk"), etc.

In one embodiment, the selection engine 1100 is configured to select messages based on the current season. For example, during particular holidays or seasons, messages may be selected which are indicative of those holidays or seasons (e.g. "happy labor day"; "spring is in the air").

In one embodiment, the selection engine 1100 is configured to select messages based on events occurring. For example, a message may ask or inform a user about an upcoming event (e.g. concerts, sporting events, festivals, shows, etc.).

In one embodiment, the selection engine 1100 is configured to select messages based on the current date or time, day of the week, month, or other indicator of time.

In one embodiment, the selection engine 1100 is configured to select messages based on previously selected messages which have been transferred to the hand-washing compliance device. For example, messages which have been recently transferred may not be selected so as to avoid duplication.

In one embodiment, the selection engine 1100 is configured to select messages based on data or activity of the user on a social network, or that of members of the user's social graph. For example, social activity of the user may indicate an interest in basketball, and a message relating to basketball may be selected.

It will be appreciated that the foregoing examples of factors according to which messages may be selected for transmission to a hand-washing compliance device, are provided by way of example and not by way of limitation. In other embodiments, additional factors may be considered by a message selection engine in accordance with the principles described herein.

It should be appreciated that the concepts relating to motion-controlled messages apply to all forms of information which may be displayed or otherwise rendered in response to detected motion from the hand-washing compliance device to or from a motionless environment. For example, a motion-controlled "message" may be defined by an image, video, video game, audio, animation, or any other type of information or communicative event that may be presented through a hand-washing compliance device in accordance with embodiments of the invention.

In the foregoing embodiments, messages have been displayed on a hand-washing compliance device in response to detected motion to or from a motionless environment defined by a lack of motion detected by the device's sensors. However, in other embodiments, a message may be configured to be displayed on the hand-washing compliance device in response to other types of changes which are detectable by the hand-washing compliance device.

Broadly speaking, the hand-washing compliance device can be configured to display a message in response to determining a change from a non-user interactive state to a user interactive state. In embodiments presented above, the non-user interactive state can be defined by insufficient motion detected for a predefined time period. A change to a user-interactive state is determined when sufficient motion from the motionless environment is detected.

In other embodiments, the change from the non-user interactive state to the user interactive state can be defined by detected actions, such as a button press or an interaction with a touchscreen (e.g. touch, swipe, gesture, etc.).

In another embodiment, a message can be configured to be displayed in response to changes in ambient light levels. For example, a sudden change from very low ambient light levels to comparatively high ambient light levels may indicate that the lights in the facility where the hand-washing compliance device has been turn on, indicating the presence of a possible user. Hence, hand-washing compliance device may be configured to display a message in response to detection of such a change in ambient light.

In another embodiment, the hand-washing compliance device may be configured to display a message in response to changes in ambient sound levels.

The aforementioned methods and systems for displaying motion-controlled messages on a hand-washing compliance device serve to improve the user experience of interacting with the hand-washing compliance device. By displaying messages in response to motion to or from a motionless environment, the hand-washing compliance device can react to the user's intent to interact with or otherwise utilize the device, as indicated by the motion. Furthermore, by intelligently selecting messages for display in a manner that is specific for the users, the experience can be highly customized.

As noted, a hand-washing compliance device 100 can communicate with a computing device (e.g., a smartphone, a tablet computer, a desktop computer, or computer device having wireless communication access and/or access to the Internet). The computing device, in turn, can communicate over a network, such as the Internet or an Intranet to provide data synchronization. The network may be a wide area network, a local area network, or a combination thereof. The network may be coupled to one or more servers, one or more virtual machines, or a combination thereof. A server, a virtual machine, a controller of a compliance device, or a controller of a computing device is sometimes referred to herein as a computing resource. Examples of a controller include a processor and a memory device.

In one embodiment, the processor may be a general purpose processor. In another embodiment, the processor can be a customized processor configured to run specific algorithms or operations. Such processors can include digital signal processors (DSPs), which are designed to execute or interact with specific chips, signals, wires, and perform certain algorithms, processes, state diagrams, feedback, detection, execution, or the like. In some embodiments, a processor can include or be interfaced with an application specific integrated circuit (ASIC), a programmable logic device (PLD), a central processing unit (CPU), or a combination thereof, etc.

In some embodiments, one or more chips, modules, devices, or logic can be defined to execute instructions or logic, which collectively can be viewed or characterized to be a processor. Therefore, it should be understood that a processor does not necessarily have to be one single chip or module, but can be defined from a collection of electronic or connecting components, logic, firmware, code, and combinations thereof.

Examples of a memory device include a random access memory (RAM) and a read-only memory (ROM). A memory device may be a Flash memory, a redundant array of disks (RAID), a hard disk, or a combination thereof.

Embodiments described in the present disclosure may be practiced with various computer system configurations including hand-held devices, microprocessor systems, microprocessor-based or programmable consumer electronics, minicomputers, mainframe computers and the like. Several embodiments described in the present disclosure can also be practiced in distributed computing environments where tasks are performed by remote processing devices that are linked through a wire-based or wireless network.

With the above embodiments in mind, it should be understood that a number of embodiments described in the present disclosure can employ various computer-implemented operations involving data stored in computer systems. These operations are those requiring physical manipulation of physical quantities. Any of the operations described herein that form part of various embodiments described in the present disclosure are useful machine operations. Several embodiments described in the present disclosure also relate to a device or an apparatus for performing these operations. The apparatus can be specially constructed for a purpose, or the apparatus can be a computer selectively activated or configured by a computer program stored in the computer. In particular, various machines can be used with computer programs written in accordance with the teachings herein, or it may be more convenient to construct a more specialized apparatus to perform the required operations.

Various embodiments described in the present disclosure can also be embodied as computer-readable code on a non-transitory computer-readable medium. The computer-readable medium is any data storage device that can store data, which can thereafter be read by a computer system. Examples of the computer-readable medium include hard drives, network attached storage (NAS), ROM, RAM, compact disc-ROMs (CD-ROMs), CD-recordables (CD-Rs), CD-rewritables (RWs), magnetic tapes and other optical and non-optical data storage devices. The computer-readable medium can include computer-readable tangible medium distributed over a network-coupled computer system so that the computer-readable code is stored and executed in a distributed fashion.

Although the method operations were described in a specific order, it should be understood that other housekeeping operations may be performed in between operations, or operations may be performed in an order other than that shown, or operations may be adjusted so that they occur at slightly different times, or may be distributed in a system which allows the occurrence of the processing operations at various intervals associated with the processing.

Although the foregoing embodiments have been described in some detail for purposes of clarity of understanding, it will be apparent that certain changes and modifications can be practiced within the scope of the appended claims. Accordingly, the present embodiments are to be considered as illustrative and not restrictive, and the various embodiments described in the present disclosure are not to be limited to the details given herein, but may be modified within the scope and equivalents of the appended claims.

What is claimed is:

1. A method for presenting and controlling a message on a motion-activated display of a hand-washing compliance device, comprising:

storing a plurality of messages to a message storage component;

determining a non-user interactive state of the device;

determining a change of the device from the non-user interactive state to a user interactive state related to the user washing their hands;

in response to determining the change from the non-user interactive state to the user interactive state, select one or more of the plurality of messages, and display the selected message(s);

wherein at least one of the parameters of at least one of the selected messages is controlled by detecting motion, or determining an absence thereof;

wherein at least one of the plurality of messages is based on one or more of a length of time of the non-user interactive state, a current time of day, a current location of the device, or an account history associated with the device; and wherein the method is executed by at least one processor.

2. The method of claim 1, wherein determining a non-user interactive state includes determining an absence of interaction between the device and a user for a predefined time period; and wherein determining the change of the device from the non-user interactive state to a user interactive state includes determining interaction between the device and a user.

3. A method for presenting and controlling a message on a motion-activated display of a hand-washing compliance device, comprising:

storing a plurality of messages to a message storage component;

determining a motionless environment;

detecting motion, or determining an absence thereof, within the environment related to the user washing his hands;

in response to detecting the motion, or determining an absence thereof, within the environment, selecting one or more of the plurality of messages, and displaying the selected message(s);

wherein at least one of the parameters of at least one of the selected messages is controlled by the detection of motion or the determination of an absence of motion;

wherein at least one of the plurality of messages is defined based on one or more of a current date, a location of the device, a current time of day, or an account history associated with the device; and wherein the method is executed by at least one processor.

4. The method of claim 3, wherein determining a motionless environment includes the determination of an absence of motion within the detection range of a motion sensor of the hand-washing compliance device for a predefined time period.

5. The method of claim 3, wherein storing a plurality of messages includes identifying the hand-washing compliance device to a server and downloading a plurality of messages from the server, the server being configured to access a user account associated with the device, the plurality of messages being selected by the server based on the user account.

6. A hand-washing compliance device, comprising:

a message storage component configured to store a plurality of messages;

a motion sensor;

a display;

logic executed by at least one processor and configured to determine, based on an output of the motion sensor, a motionless environment and detect motion or determine an absence thereof within the environment related to the user washing his hands, and, in response to detecting the motion or determining an absence thereof within the environment, select one or more of the plurality of messages, and display the selected message(s); and logic configured to determine a non-user interactive state of the device and a subsequent change to a user interactive state of the device, and, in response to determining the change to the user interactive state, select one or more of the plurality of messages, and display the selected message(s);

wherein at least one of the plurality of messages is defined based on an account history associated with the device.

7. The hand-washing compliance device of claim 6, wherein determining a motionless environment includes the determination of an absence of motion within the detection range of a motion sensor of the hand-washing compliance device for a predefined time period.

8. The hand-washing compliance device of claim 6, wherein determining a non-user interactive state includes determining an absence of interaction between the device and a user for a predefined time period; and wherein determining the change of the device from the non-user interactive state to a user interactive state includes determining interaction between the device and a user.

9. The hand-washing compliance device of claim 6, further comprising logic configured to download a plurality of messages to the hand-washing compliance device's message storage component, wherein the downloading includes identifying the device to a server, the server being configured to access a user account associated with the device, the plurality of messages being selected by the server based on the user account.

* * * * *